US010181372B2

(12) United States Patent
Simpkins et al.

(10) Patent No.: US 10,181,372 B2
(45) Date of Patent: Jan. 15, 2019

(54) ASSEMBLY COMPRISING A TWO-STAGE CRYOGENIC REFRIGERATOR AND ASSOCIATED MOUNTING ARRANGEMENT

(71) Applicant: SIEMENS PLC, Camberley (GB)

(72) Inventors: Michael Simpkins, Buckinghamshire (GB); Neil Charles Tigwell, Witney (GB); Kevin Paul Wastie, Oxfordshire (GB)

(73) Assignee: Siemens Healthcare Limited, Camberley (GB)

( * ) Notice: Subject to any disclaimer, the term of this patent is extended or adjusted under 35 U.S.C. 154(b) by 65 days.

(21) Appl. No.: 14/787,148

(22) PCT Filed: Apr. 17, 2014

(86) PCT No.: PCT/EP2014/057900
§ 371 (c)(1),
(2) Date: Oct. 26, 2015

(87) PCT Pub. No.: WO2014/173809
PCT Pub. Date: Oct. 30, 2014

(65) Prior Publication Data

US 2016/0078987 A1 Mar. 17, 2016

(30) Foreign Application Priority Data

Apr. 24, 2013 (GB) ..... 1307355.6
Apr. 30, 2013 (GB) ..... 1307783.9

(51) Int. Cl.
*H01F 6/04* (2006.01)
*F28F 13/18* (2006.01)
(Continued)

(52) U.S. Cl.
CPC ..... *H01F 6/04* (2013.01); *F17C 3/085* (2013.01); *F25B 9/14* (2013.01); *F25D 19/006* (2013.01);
(Continued)

(58) Field of Classification Search
CPC ..... F17C 3/058; F17C 2227/0353; F25D 19/006; F28F 13/18; F25B 9/14; H01F 6/04
(Continued)

(56) References Cited

U.S. PATENT DOCUMENTS 3,609,992 A * 10/1971 Cacheux ..... F17C 3/085 165/185
3,807,188 A 4/1974 Lagodmos
(Continued)

FOREIGN PATENT DOCUMENTS

CN 1470819 A 1/2004
DE 10 2005 002 361 B3 6/2006
(Continued)

OTHER PUBLICATIONS

Fasteners and Springs—Peterson Enterprises (2013).*
Types of Metallic Bellows Deflection—U.S. Bellows, Inc. (2010).*
JP 2004294041 A English Machine Translation—Retrieved Feb. 2018.*

*Primary Examiner* — Len Tran
*Assistant Examiner* — Jenna M Hopkins
(74) *Attorney, Agent, or Firm* — Schiff Hardin LLP

(57) ABSTRACT

An assembly has a two-stage cryogenic refrigerator and an associated mounting arrangement, and a sock having first and second stages corresponding to first and second stages of the refrigerator, with the first stage of the refrigerator being in thermal contact with the first stage of the sock and
(Continued)

the second stage of the refrigerator being in thermal contact with the second stage of the sock.

7 Claims, 12 Drawing Sheets

(51) Int. Cl.
*F25B 9/14* (2006.01)
*F25D 19/00* (2006.01)
*F17C 3/08* (2006.01)

(52) U.S. Cl.
CPC ..... *F28F 13/18* (2013.01); *F17C 2227/0353* (2013.01)

(58) Field of Classification Search
USPC ..... 62/51.1, 6
See application file for complete search history.

(56) References Cited

U.S. PATENT DOCUMENTS 4,606,201 A * 8/1986 Longsworth ..... F25B 9/02 62/51.2
4,667,486 A * 5/1987 Miller ..... F25D 19/006 285/47
4,667,487 A * 5/1987 Miller ..... F25D 19/006 285/47
4,876,413 A * 10/1989 Vermilyea ..... G01R 33/3815 174/15.4
4,986,077 A * 1/1991 Saho ..... F02G 1/0445 250/352
5,111,665 A * 5/1992 Ackermann ..... F25D 19/006 505/894
5,111,667 A 5/1992 Hafner et al.
5,129,232 A * 7/1992 Minas ..... F16F 15/04 248/636
5,301,507 A * 4/1994 Laskaris ..... F25D 19/006 165/185
5,381,666 A 1/1995 Saho et al.
5,430,423 A * 7/1995 Herd ..... F25D 19/006 335/216
5,522,226 A * 6/1996 Mruzek ..... F25D 19/006 165/185
5,613,365 A * 3/1997 Mastrup ..... F25B 9/145 60/520
5,828,280 A * 10/1998 Spivey, Jr. ..... F17C 13/025 335/216
5,884,489 A * 3/1999 Retz ..... G01R 33/3815 335/216
5,918,470 A 7/1999 Xu et al.
7,475,552 B2 1/2009 Sorsby
8,910,486 B2 * 12/2014 Bin-Nun ..... F25B 9/14 62/51.2
2004/0144101 A1 7/2004 Hofmann
2007/0271933 A1 * 11/2007 Miki ..... C01B 3/0089 62/51.1
2008/0036463 A1 * 2/2008 Hsieh ..... G01R 33/3806 324/319
2008/0104968 A1 * 5/2008 Radovinsky ..... F25D 19/006 62/6
2008/0216486 A1 9/2008 Hughes et al.
2009/0293504 A1 12/2009 Oomen et al.
2010/0050661 A1 * 3/2010 Snow ..... F25B 9/14 62/51.1
2015/0015260 A1 * 1/2015 Harrison ..... H01F 6/04 324/318

FOREIGN PATENT DOCUMENTS

JP H05245394 A 9/1993
JP H11257770 A 9/1999
JP 2004294041 A * 10/2004

* cited by examiner

ASSEMBLY COMPRISING A TWO-STAGE CRYOGENIC REFRIGERATOR AND ASSOCIATED MOUNTING ARRANGEMENT

BACKGROUND OF THE INVENTION

Field of the Invention

The present invention relates to improved arrangements for providing thermal connection between a cryogenic refrigerator and cooled components, wherein the refrigerator is removable, and the thermal connection must be capable of being broken and re-made without discernible increase in thermal resistance.

The present invention is particularly described in the context of a two-stage cryogenic refrigerator cooling to temperatures of about 4.2K for re-condensing helium in a cryostat used for cooling superconducting magnets for MRI systems.

Description of the Prior Art

FIG. 1 shows a conventional arrangement of a cryostat including a cryogen vessel 12. A cooled superconducting magnet 10 is provided within cryogen vessel 12, itself retained within an outer vacuum chamber (OVC) 14. One or more thermal radiation shields 16 are provided in the vacuum space between the cryogen vessel 12 and the outer vacuum chamber 14. In some known arrangements, a refrigerator 17 is mounted in a refrigerator sock 15 located in a turret 18 provided for the purpose, towards the side of the cryostat. Alternatively, a refrigerator 17 may be located within access turret 19, which retains access neck (vent tube) 20 mounted at the top of the cryostat. The refrigerator 17 provides active refrigeration to cool cryogen gas within the cryogen vessel 12, in some arrangements by recondensing it into a liquid. The refrigerator 17 may also serve to cool the radiation shield 16. As illustrated in FIG. 1, the refrigerator 17 may be a two-stage refrigerator. A first cooling stage 30 is thermally linked to the radiation shield 16, and provides cooling to a first temperature, typically in the region of 80-100K. A second cooling stage 32 provides cooling of the cryogen gas to a much lower temperature, typically in the region of 4-10K. In current cryogenic refrigerators, the first stage may provide about 44 W of cooling to 50K and about 1 W of cooling at about 4K.

A negative electrical connection 21*a* is usually provided to the magnet 10 through the body of the cryostat. A positive electrical connection 21 is usually provided by a conductor passing through the vent tube 20.

U.S. Pat. Nos. 4,667,487, 4,986,077, JP H05 245394A describe conventional arrangements for mounting a cryogenic refrigerator.

The present invention is particularly concerned with mounting arrangements for cryogenic refrigerator 17 and its interface with refrigerator sock 15.

A first stage 30 of the refrigerator 17 is generally pressed into contact with a first stage of the sock. That first stage of the sock is generally in thermal contact with thermal radiation shield 16. At a lower, closed, end of the sidesock, a second stage 32 of the refrigerator is provided. When in position, the second stage 22 of the refrigerator 17 may be pressed into contact with a second stage of the sock 15. The second stage of the sock is typically thermally linked to a heat exchanger which is exposed to gaseous cryogen in the cryogen vessel 12. In some arrangements, the heat exchanger is exposed directly to the interior of the cryogen vessel. In other arrangements, the heat exchanger is positioned within a small recondensing chamber, which is linked to the main cryogen vessel by one or more passageways.

In such arrangements, it is important to have a suitable mechanical pressure on both first and second stages of the refrigerator, to provide effective thermal contact between stages of refrigerator 17 and stages of sock 15 which must be maintained when in use at cryogenic temperatures.

Refrigerator sock 15 may have a flexible connection of some sort built in, in an attempt to ensure effective mechanical connection despite variations in component sizes due to build tolerances.

The first and second stages of the refrigerator 17 are more clearly visible in FIG. 2. In case of insufficient thermal contact between refrigerator and sock, effective cooling will not be provided to the thermal radiation shield and the heat exchanger; and it may not be possible to maintain the required temperature within the cryogen vessel. For example, a hard mechanical contact may be employed, in which the second stage heat exchanger 32 is pressed into mechanical contact with a heat exchanger. This is typically arranged by careful selection of the length of the sock 15 particularly the distance between first and second stages of the sock to correspond to the distance between first and second stages of the refrigerator. Thermal contact between the first stage of the refrigerator and the first stage of the sock may be achieved by direct mechanical contact, in which the first stage of the refrigerator and the first stage of the sock are provided by solid metal pieces with complementary tapers. Due to dimensional variation inherent in the manufacturing processes, it is difficult to reliably achieve an appropriate mechanical pressure between the second stage of the refrigerator and a second stage of the sock, arranged in contact with the thermal bus bar as well as an appropriate mechanical pressure between the first stage of the refrigerator and the first stage of the sock. If mating faces of the stages of the refrigerator and the stages of the sock are not accurately formed due to assembly tolerances, then the thermal contact surface area, and therefore recondensing performance, may be reduced. The second stage of the sock is typically placed at the closed end of the sock, and so the distance between the first stage of the sock and the second stage of the sock is fixed during construction of the sock. It must also be possible to remove the refrigerator from the sock for servicing and replace or substitute it, yet achieve an acceptable thermal contact with the thermal bus bar when the refrigerator is re-installed.

FIG. 13 shows an example prior art arrangement, as described in US2005/0166600, where a cryogenic refrigerator R having a first stage H1 and a second stage H2 is located within a sock 2 itself having a first stage F1 and a second stage F2. In order to make effective thermal joints between respective first and second stages, pressure is applied to an upper flange 4 of the refrigerator, typically by bolting the upper flange to a mounting point F3 at the top of the sock, attached to the cryostat 100. This presses the refrigerator into the sock, and provides contact pressure between the first stage H1 of the refrigerator and the first stage F1 of the sock; and between the second stage H2 of the refrigerator and the second stage F2 of the sock. Depending on build tolerances of the various components concerned, the distribution of contact force between first and second stages will vary. It may be found prudent to provide an indium washer 3*a*, 3*b* or a layer of thermally conductive grease between the refrigerator and the sock at each stage, but such indium washers or grease are difficult to remove when a refrigerator is removed for servicing and replaced. More significantly, a relatively large force is applied to the flange 4, which places a compressive force on the refrigerator, and a tensile force of the sock. The refrigerator R is a fragile precision machine, and it would be preferable to avoid placing significant forces on the body of the refrigerator.

SUMMARY OF THE INVENTION

The present invention provides an efficient thermal joint between the second stage of a refrigerator and a cooled component such as a heat exchanger. The present invention avoids placing significant forces on the body of the refrigerator.

DESCRIPTION OF THE PREFERRED EMBODIMENTS

The present invention provides an improved refrigerator sock and improved interface arrangements to ensure effective thermal contact between stages of a two-stage cryogenic refrigerator and corresponding stages of a refrigerator sock.

According to a feature of the present invention, the second stage of the refrigerator is mechanically attached to a cooled component by one or more bolts or similar mechanical fasteners. Preferably, the mechanical fastener is accessible from the exterior of the sock, and of the OVC. A sealed port may be provided to allow access to the fastener when required for removal or installation of a cryogenic refrigerator.

In an example of the present invention, the refrigerator is mounted in an evacuated refrigerator sock, but the thermal contact surfaces of the refrigerator and the sock are pressed together by bolts or similar mechanical fasteners. Other similar fixing means may be used in other embodiments. One or more fastener is used which allows a controlled clamping force to be provided between the second stage of the refrigerator and the second stage of the sock, without requiring a compressive axial load on the body of the refrigerator. The controlled clamping force will, if necessary, provide some deformation of one or more stage of the refrigerator and/or one or more stage of the sock, thereby to provide an increased contact area between refrigerator and sock. This is beneficial because effective thermal contact may be provided even though some parts of the refrigerator and/or sock may be of inaccurate construction, within allowed manufacturing tolerances.

Figure 1:
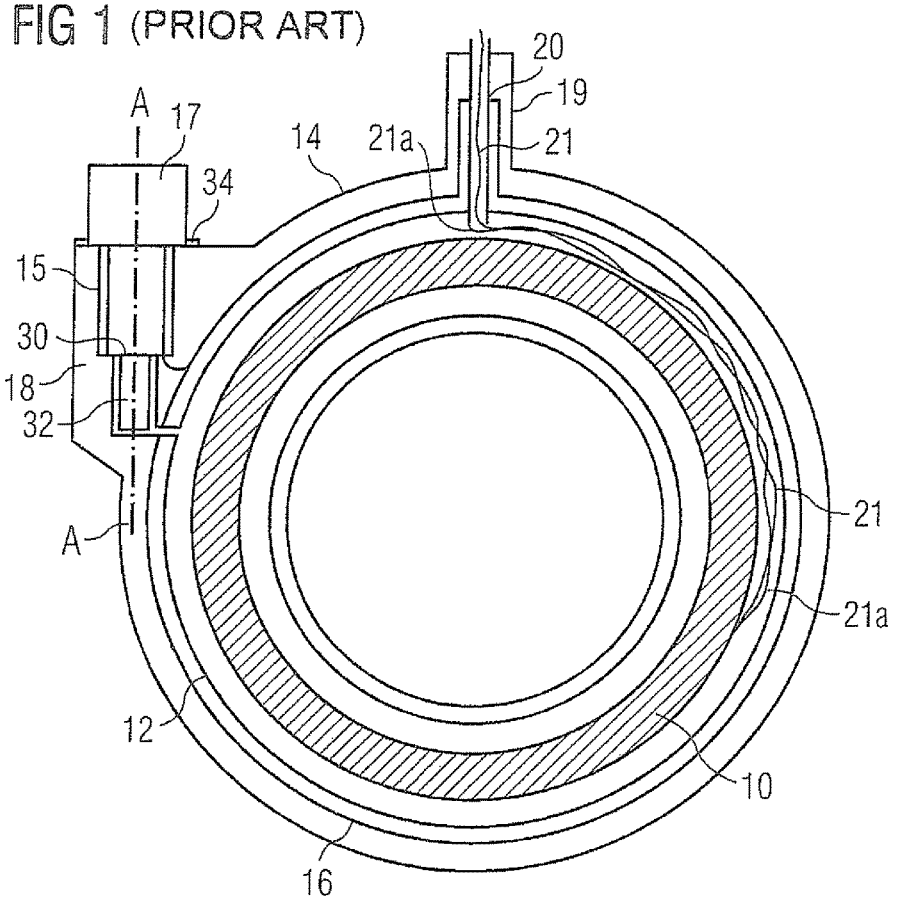
FIG 1 (PRIOR ART)
FIG. 1 schematically illustrates a conventional cryogenically-cooled superconducting magnet assembly, which may be modified according to the present invention.

FIGS. 2-8 show refrigerator 17 and refrigerator sock 15 with their axis A-A approximately horizontal. In embodiments of the present invention, in use, axis A-A will typically be approximately vertical, as shown in FIG. 1, but is shown approximately horizontal in the drawings for ease of representation. The sock can be at any angle although the refrigerator works better vertical, either "upright" as shown in FIG. 1 or inverted.

Figure 2:
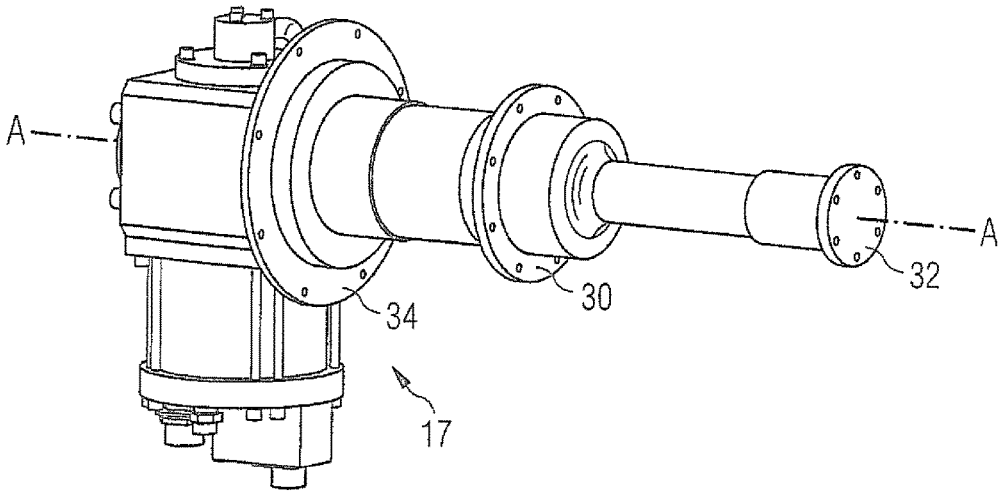
FIG 2 (PRIOR ART)
FIG. 2 illustrates a commercially-available cryogenic refrigerator which may be used in an arrangement of the present invention.

FIG. 2 shows a two-stage cryogenic refrigerator 17, as commercially available, to which the present invention may be applied. The refrigerator has a first stage 30 and a second stage 32. An OVC flange 34 is provided to attach the refrigerator to the OVC 14, and which is used to provide a vacuum seal for the refrigerator sock 15. In operation, the first stage 30 is cooled to a temperature of about 50-80K, and the second stage is cooled to a temperature of about 4K, to provide recondensation of helium. The inner workings of the cryogenic refrigerator 17 are not the subject of the present invention.

Figure 3A:
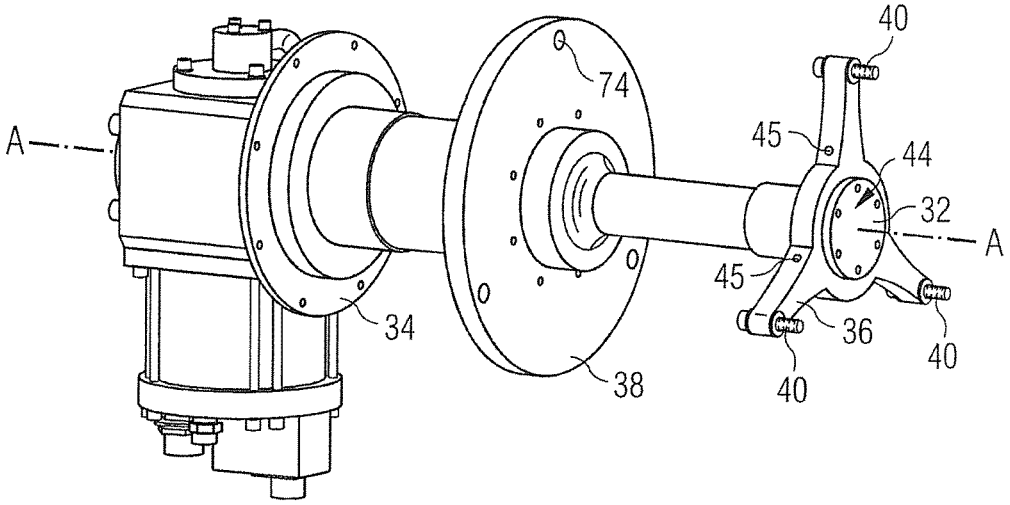
FIGS. 3A and 3B show the refrigerator of FIG. 2 modified according to certain features of the present invention.
Figure 3B:
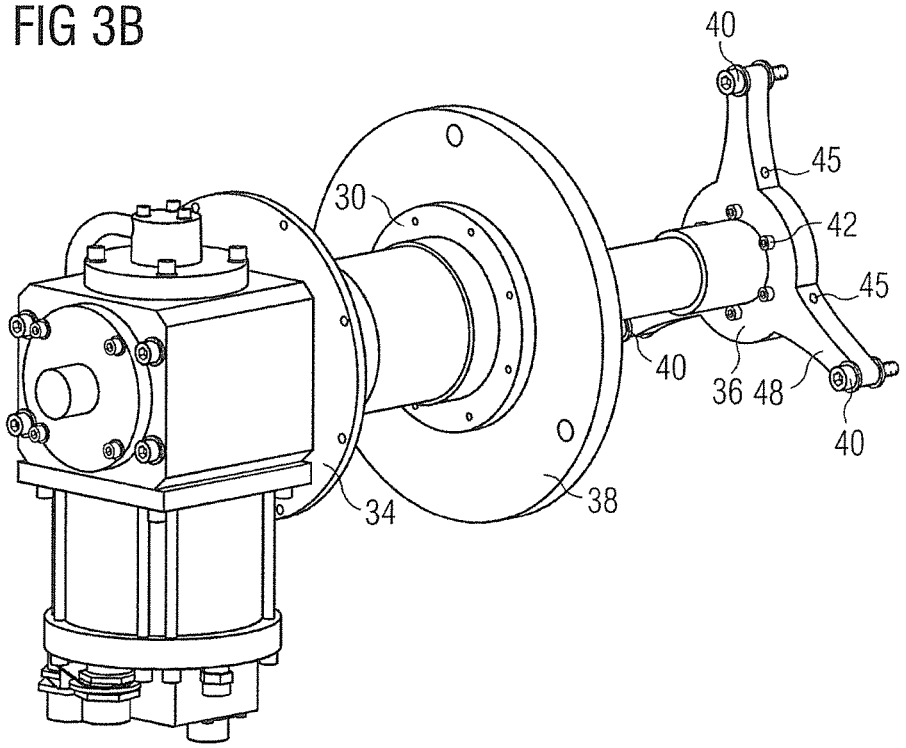

FIGS. 3A and 3B show a cryogenic refrigerator 17 similar to that shown in FIG. 2, modified according to an aspect of the present invention, from two viewpoints. A bracing piece 36 is shown attached to the second stage 32. A lower surface 44 of the second stage protrudes beyond the bracing piece 36. The bracing piece 36 is shown formed of more than one piece, assembled together around the second stage by fasteners 45, and mechanically attached to the second stage by further fasteners 42. Three protrusions 48 are shown, being parts of the bracing piece which extend radially away from the second stage 32. More or fewer than three may be provided, but three is the presently preferred number. Each of the protrusions carries a captive fastener 40. The captive fastener may be a bolt with recessed hexagonal head, although equivalent fastenings may be used. The purpose of the bracing piece and the fasteners will be explained below.

Figure 4:
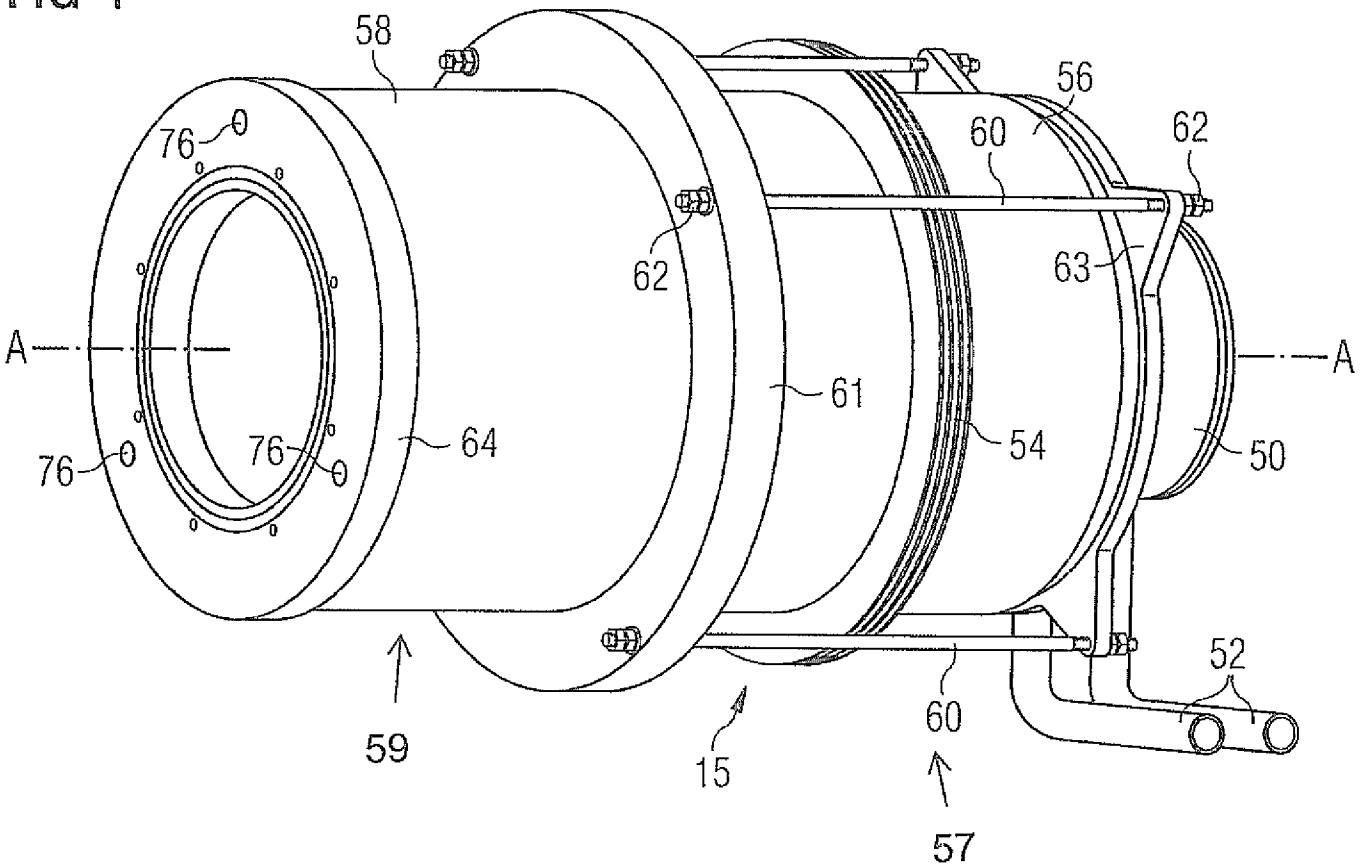
FIG. 4 shows a sock for accommodating a cryogenic refrigerator, according to certain features of the present invention.

FIG. 4 shows an example of a refrigerator sock 15 according to an aspect of the present invention. First stage 61 is shown. When installed within a cryostat, first stage 61 will be in thermal contact with the thermal radiation shield 16 (shown in FIG. 1 as described above, but not shown in FIG. 4). A heat exchanger 70 is provided at the closed end of the sock, thermally linked to the second stage of the sock, as a recondensing chamber 50 is positioned around the heat exchanger. The second stage of the sock is not visible in FIG. 4, but is shown with reference numeral 68 in FIG. 5. Cryogen feed and return pipes 52 are shown. In use, these would provide access between the cryogen vessel 12 and the recondensing chamber 50. A bellows arrangement 54 is provided in a wall 56 of a lower section 57 of the sock 15, said lower section extending between the first stage 61 and the second stage 68. A wall 58 of an upper part 59 of the sock does not require a bellows section, since variation in build tolerance may be accommodated between the OVC and first stage by an o-ring seal (not illustrated) at the interface between the OVC and the refrigerator flange 34. Mechanical tic rods 60 brace first stage 61 of the sock against second stage retaining structure 63. As shown, the tie rods are simple rods 60 with threaded ends, and nuts 62 or similar fasteners bear against the first stage 61 of the sock and the second stage retaining structure 63, providing tension in the tie rods. In the illustrated embodiment, four tie rods 60 are shown, although more or fewer could be used. An upper interface piece 64 is shown. In use, interface piece 64 will typically be welded into a corresponding hole in OVC 14, to seal the interior of the sock from the interior of the OVC, and provide a mounting point for OVC flange 34.

Figure 5:
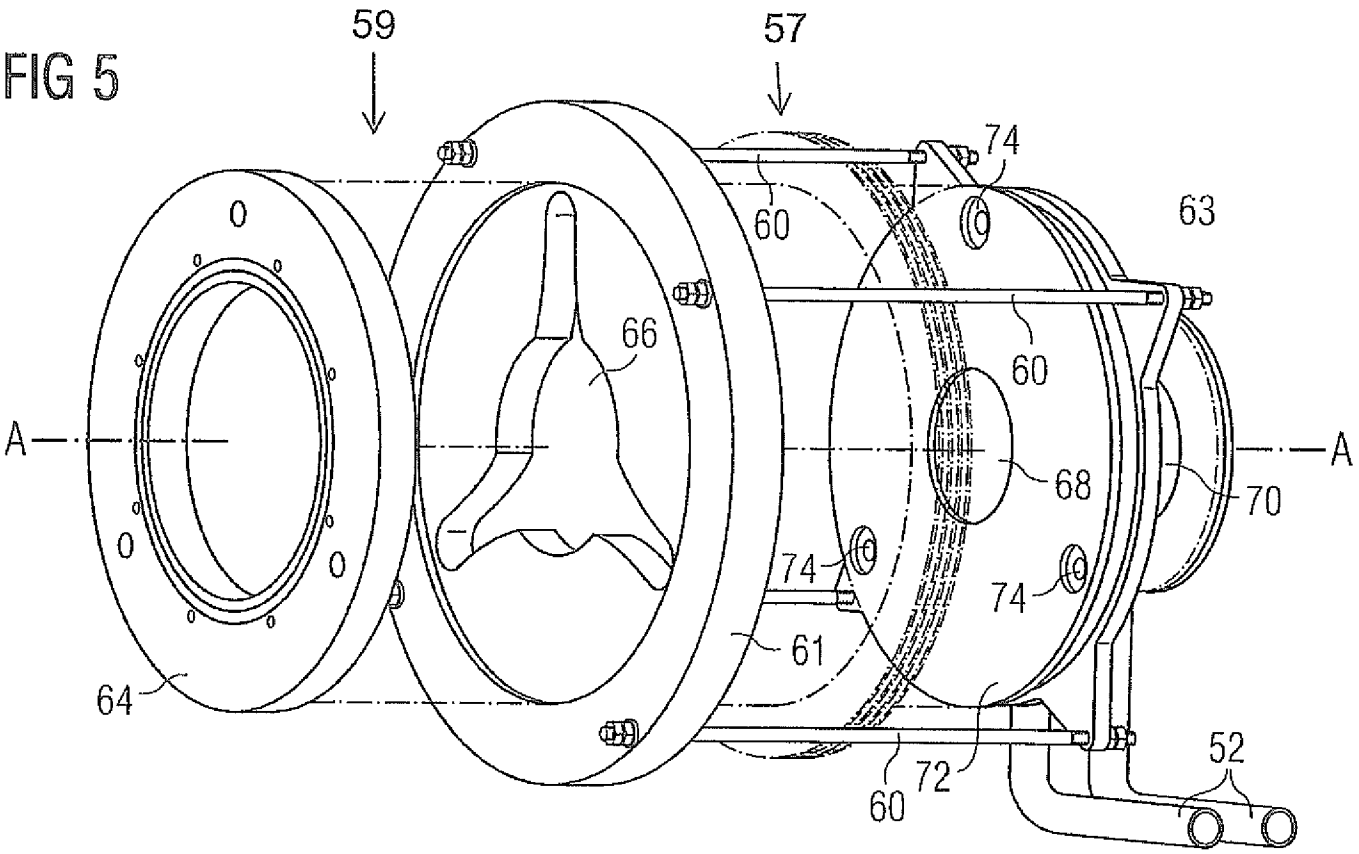
FIG. 5 shows a similar view to that of FIG. 4, but in which certain features are shown transparent.

FIG. 5 shows a similar view of the refrigerator sock 15, this time with the walls 58, 56 of the sock shown transparent. In this drawing, it is shown that the first stage 61 of the sock is provided with a cut-out 66 of suitable shape and size to allow the bracing piece 36 attached to refrigerator 17 to pass through. Second stage 68 is visible, along with heat exchanger 70 which is thermally linked to second stage 68. End piece 72 is shown, closing the end of the sock, and braced against first stage 61 by retaining structure 63 and tie rods 60. End piece 72 contains tapped holes or recesses 74 to accommodate fasteners 40, as will be explained below. Item 64 is welded to the OVC, and will need to have a central hole which is large enough hole for bracing piece 36 and first stage interface piece 38 to pass through.

Figure 6:
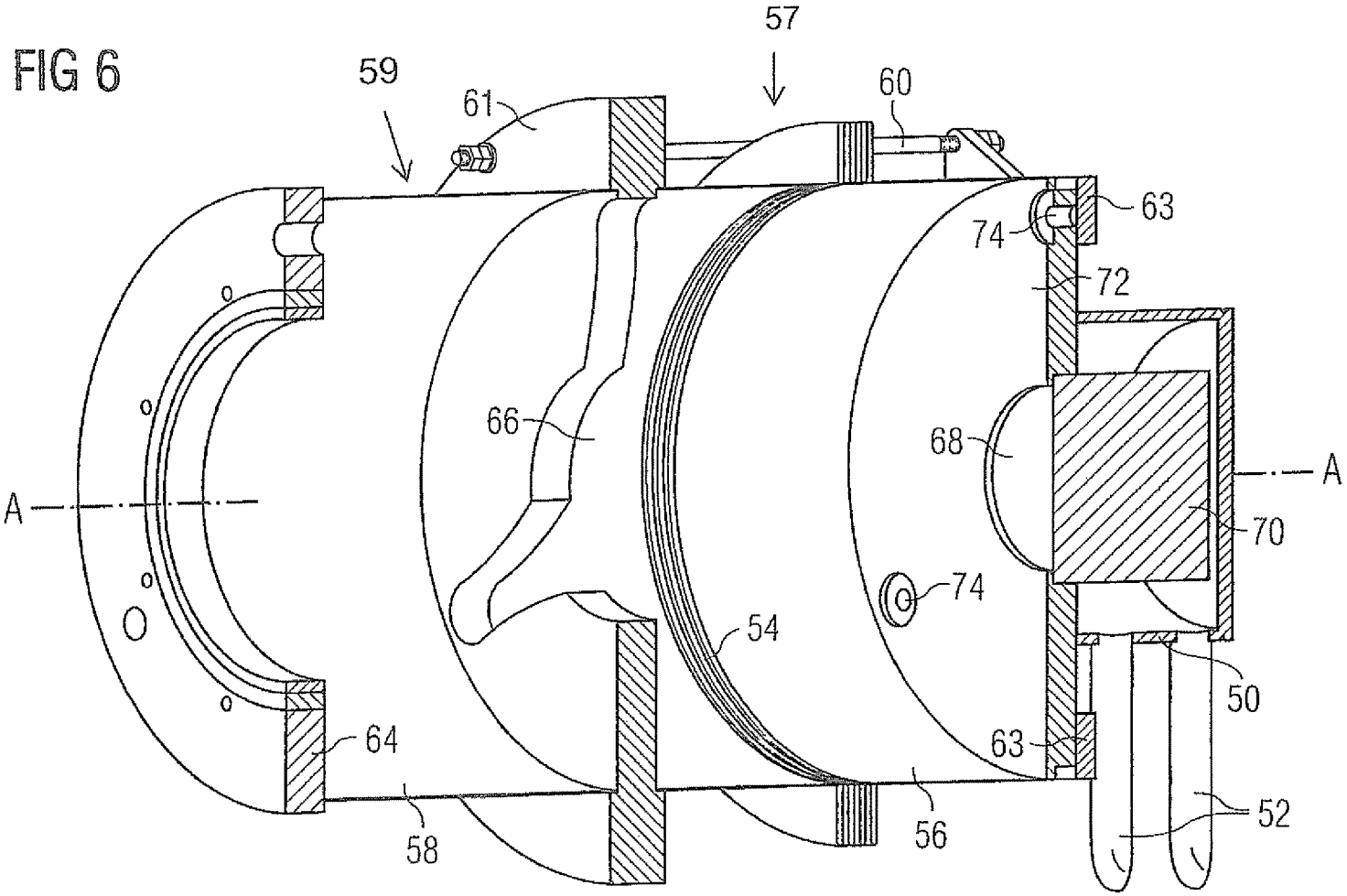
FIG. 6 shows an axial cross-section through a sock as illustrated in FIGS. 4, 5.

FIG. 6 shows a cross-section through the structure of FIG. 5, taken in a plane containing axis A-A. The detailed structure of the lower section 57 of the sock, described above, is more clearly illustrated in this drawing.

Figure 7:
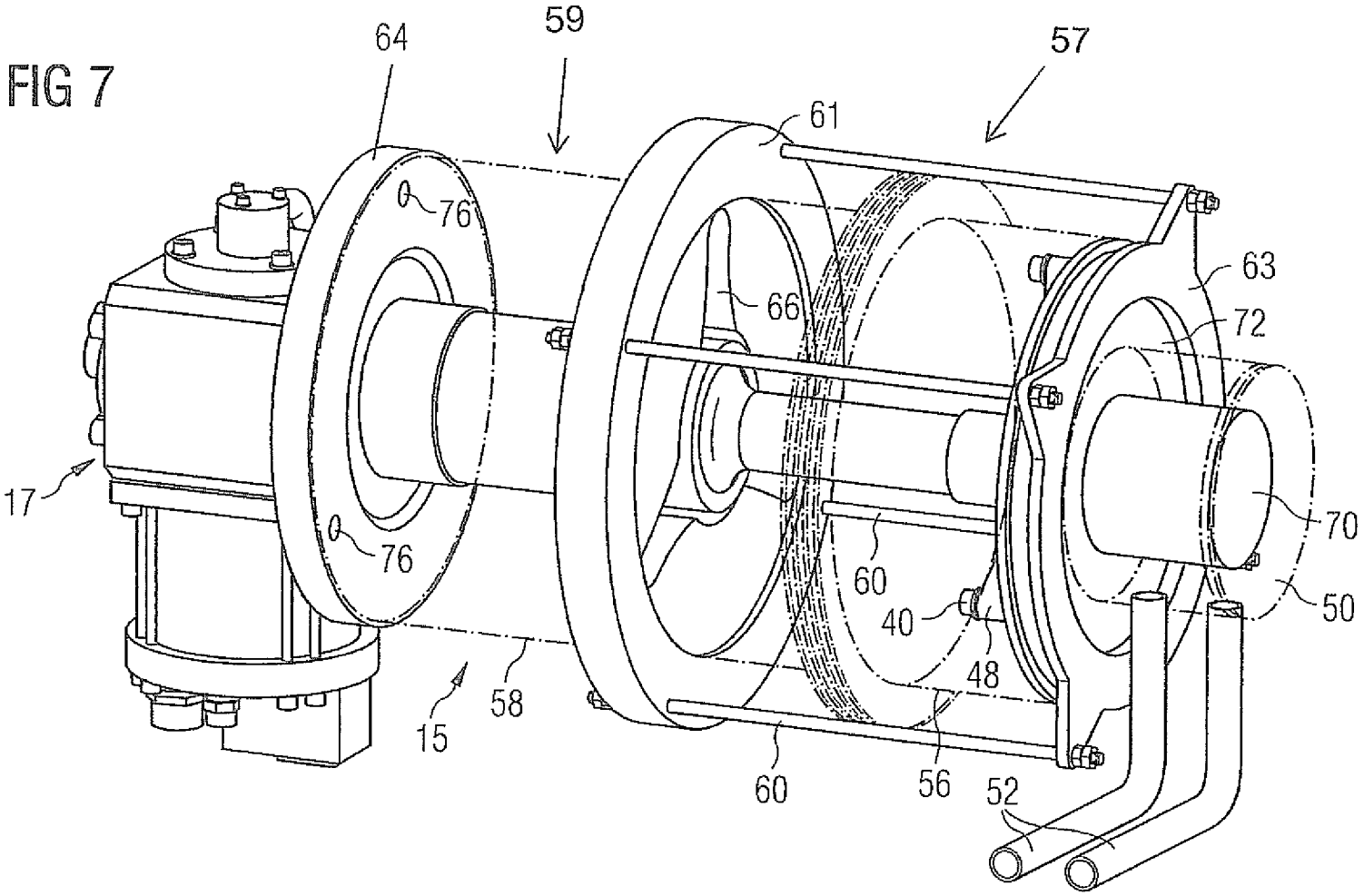
FIG. 7 shows a view of the refrigerator of FIGS. 3A, 3B assembled into a sock as shown in FIG. 5.
Figure 8:
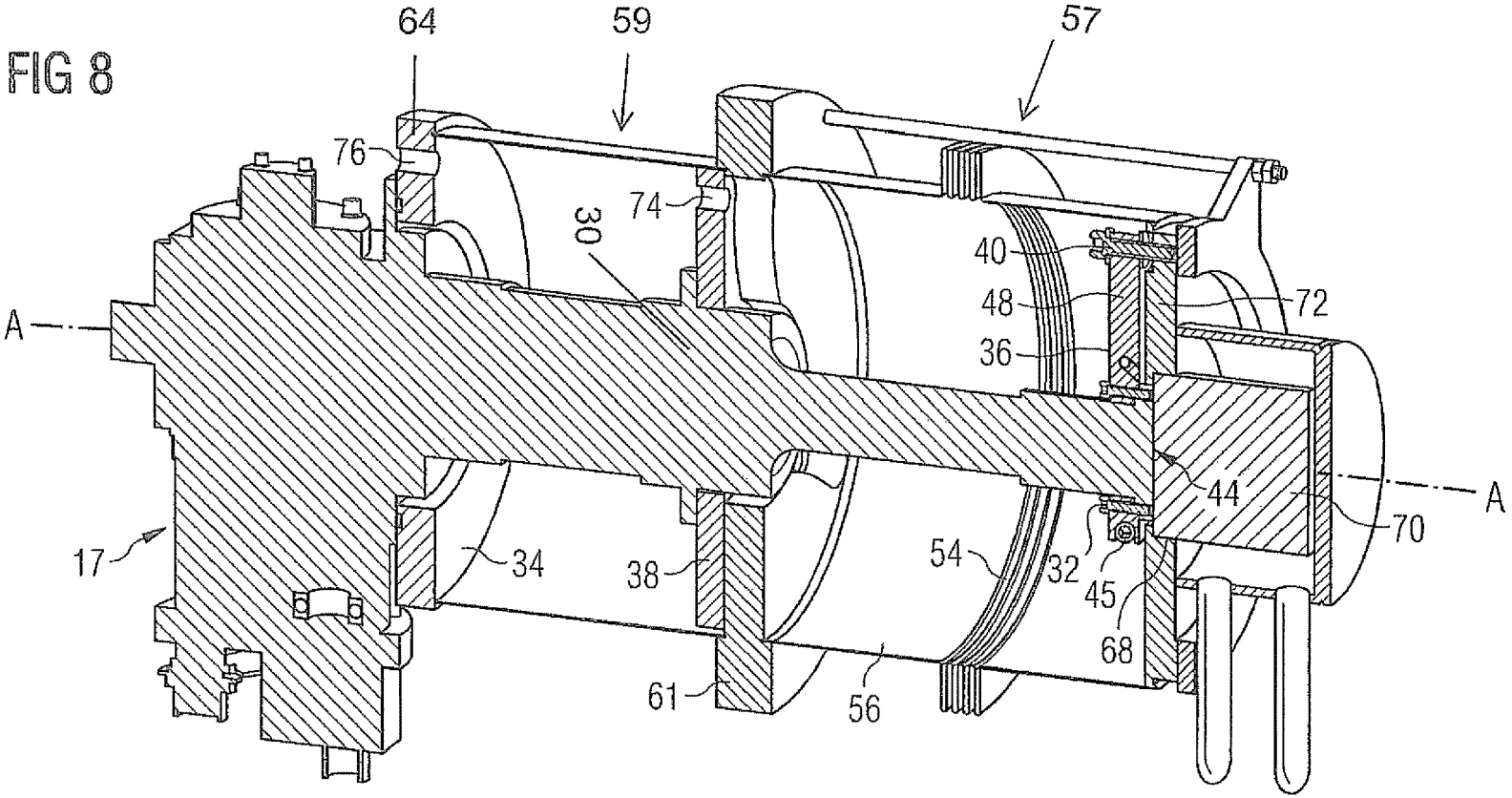
FIG. 8 shows an axial cross-section through the assembly of FIG. 7.

FIG. 7 shows a view, similar to the view in FIG. 5, where the walls 56, 58 of the sock are shown transparent. FIG. 8 shows a similar view, in cross-section, taken in a plane containing axis A-A. The refrigerator 17 is shown in place. Protrusions 48 of the bracing piece 36 are mechanically attached to the end piece 72 by fasteners 40 which may be recessed-hex headed M8 or M10 bolts, for example. As mentioned above, second stage 32 of the refrigerator protrudes beyond the bracing piece 36. Tension in fastener 40 causes end surface 44 of second stage 32 of the refrigerator to press onto an exposed surface of the second stage 68 of the refrigerator sock. This places the second stage of the refrigerator in effective thermal contact with the second stage 68 of the sock, and the heat exchanger 70. By appropriate selection of the axial length of the wall 56 of the lower section 57 of the sock, and force required to deform bellows 54, one can ensure that, at the same time that effective thermal contact is provided between the second stage 32 of the refrigerator 17 and the second stage 68 of the sock, a suitable pressure is provided between the first stage 30 of the refrigerator, first stage interface piece 38 and the first stage 61 of the sock.

The fasteners 40 must be tightened after the refrigerator 17 has been placed in the sock 15. Access must be provided for a tool to reach the heads of fasteners 40 once the refrigerator is in place. Typically, the heads of fasteners 40 are about 400 mm below the surface of the OVC.

As shown in FIGS. 3A, 3B, 8 access holes 74 are provided in the first stage interface piece 38 and interface piece 64 to allow a tool, such as a long Allen key, to reach the heads of fasteners 40 to tighten them. Similarly, as shown in FIG. 7, the cut-out 66 in the first stage 61 of the sock 15 is aligned with the fasteners 40. These are also aligned with the fasteners 40. Accordingly, once the refrigerator 17 is located in the sock 15, a tool such as a long Allen key or screwdriver, as appropriate for the type of fastener 40 selected, is passed through access holes 76, 74 and cut-out 66 to reach fasteners 40. Fasteners 40 are then tightened to a predefined torque, which is sufficient to ensure an effective contact surface area between end surface 44 of second refrigerator stage 32 and the adjacent surface of the second stage 68 of the sock.

Preferably, the length of the lower wall 56 of the sock, including bellows 54, is such that the tightening of the fasteners 40 causes some compression of the bellows 54. Alternatively, or in addition, the relative thermal expansion coefficients of the components cause some compression of bellows 54 as the refrigerator cools to its operational temperature. The compression of the bellows 54 ensures that an appropriate interface pressure is provided between the first stage 30 of the refrigerator and the first stage 61 of the sock. Such interface pressure remains within a tolerable range even though the precise axial separation between first and second stages of the refrigerator and first and second stages of the sock may vary due to build tolerances. Later on, a vacuum is pumped in the sock, the bellows will relax due to loss of internal atmospheric pressure as discussed in further detail below.

The fasteners 40 are accessed through upper interface piece 64. Preferably, the fasteners are captive, and in addition to providing clamping force, they can be used as jacking screws for removal of the refrigerator.

Another feature of this design is the tie rods 60 which span the first 61 and second 68 stages of the sock 15. When the refrigerator 17 is fitted, the sock 17 has atmospheric pressure internally and vacuum externally, on the surface exposed to the interior of the OVC. Atmospheric pressure acting on the base of the sock 15 will tend to extend the bellows. Under these conditions the tie bars 60 and restraining structure 63 restrain the end piece 72 to prevent overextension of the bellows 54. When the refrigerator 17 is fitted and a vacuum is drawn within the sock 15, the bellows are slightly compressed, disconnecting the end piece 72 from restraining structure 63, causing the tie bars 60 to become inactive and therefore preventing the tie bars 60 acting as a heat transfer path during operation of the refrigerator 17.

In preferred embodiments of the present invention, a conformal layer of indium or thermally conductive grease suitable for use at a temperature of about 4K may be provided between first stage 61 of the sock and the first stage 30 of the refrigerator. This conformal layer assists with ensuring an effective thermal contact between the first stage 30 of the refrigerator and the first stage 61 of the sock. Similarly, a conformal layer of indium or thermally conductive grease suitable for use at a temperature of about 4K may be placed between the second stage 32 of the refrigerator and the second stage 68 of the sock. A piston-type o-ring seal may be provided at the OVC to enable build tolerances to be taken up at the first stage.

In the above embodiments, the or each fastener is located within a section of the sock extending between the first stage of the sock and the second stage of the sock. The fastener(s) act on the second stage of the refrigerator and the second stage of the sock to mechanically clamp the second stage of the refrigerator into contact with the second stage of the sock.

Figure 9:
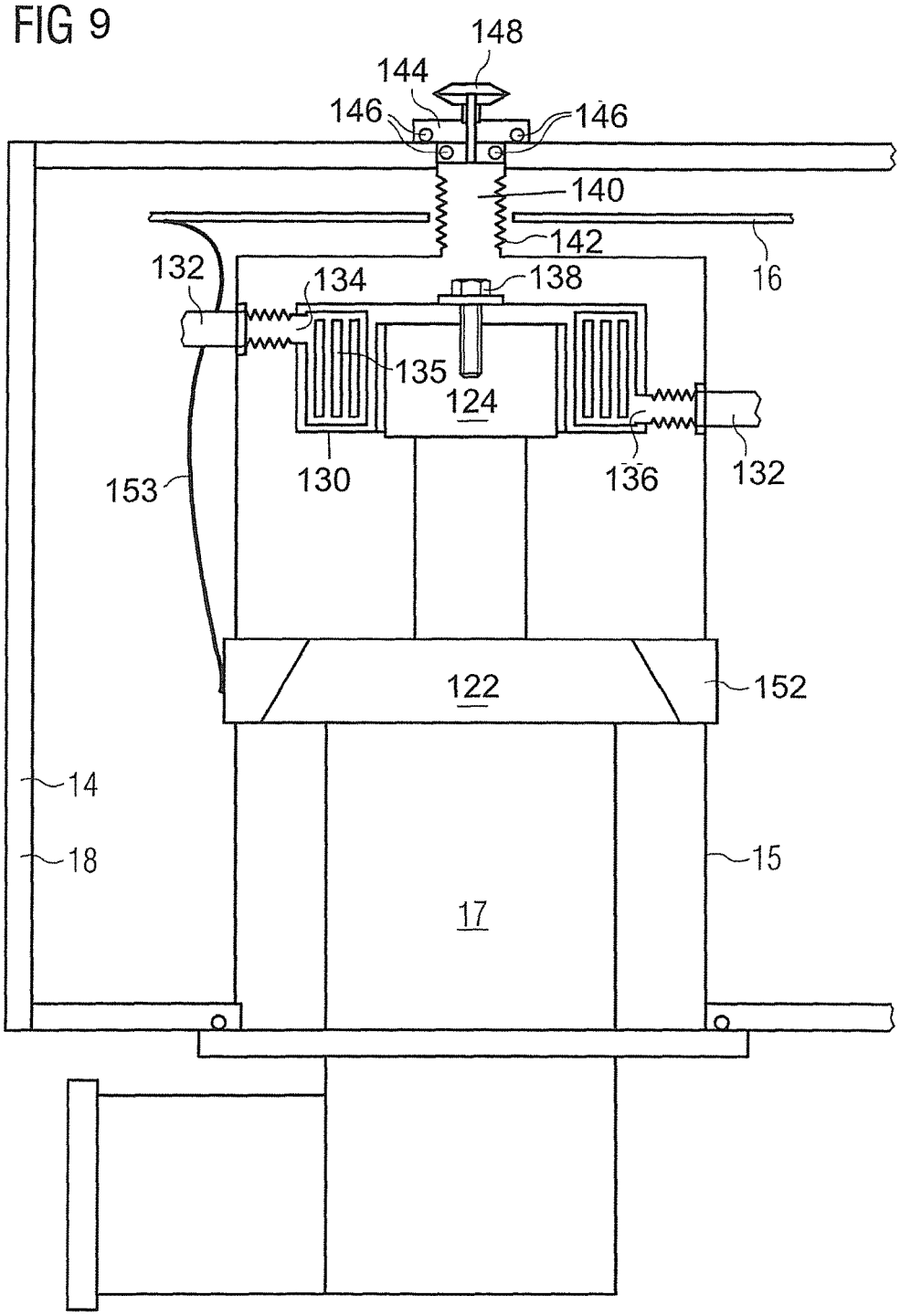
FIG. 9 illustrates a cross-section through a refrigerator and mounting arrangement according to another embodiment of the present invention.

FIG. 9 illustrates another example embodiment of the present invention, in which the cryogenic refrigerator 17 is inverted, such that the second stage 124 of the refrigerator is above the first stage 122 of the refrigerator, and the closed end of the sock 15 is above the open end. Such an arrangement allows heat exchanger 130 to be more easily positioned at a top of a thermosiphon, but the present invention extends also to arrangements in which the refrigerator is mounted more conventionally, with the second stage 124 below the first stage 122, and the closed end of the sock 15 below the open end of the sock.

In the embodiment illustrated in FIG. 9, heat exchanger 130 is provided, which is a part of a thermosiphon cooling loop arrangement. Thermosiphon tubes 132 are connected to the heat exchanger 130 through the wall of the sock 15. The heat exchanger 130 is placed within a section of the sock, extending between the first stage 152 and the closed end of the sock. Heat exchanger 130 defines a chamber 135 which is cooled by the cryogenic refrigerator 17. In use, relatively warm cryogen gas will enter chamber 135 of the heat exchanger 130 through an inlet port 134. Heat is extracted from the cryogen by second stage 124 of the refrigerator 17. The cooled cryogen may recondense into a liquid. The cooled, preferably liquid, cryogen flows from outlet port 136 to re-circulate around the thermosiphon cooling loop through tubes 132. Inlet and outlet ports 134, 136 preferably include a flexible element, such as the bellows illustrated. This allows some relative movement of heat exchanger 130 to compensate for mechanical misalignment and differences in thermal contraction. According to a feature of the present invention, the heat exchanger 130 is attached to the second stage 124 of the refrigerator by one or more bolts 138 or similar mechanical fastening which allows a controlled interface pressure to be achieved between the heat exchanger 130 and the second stage 124 of the refrigerator. The present invention avoids placing significant forces on the body of the refrigerator. Locating means, such as a peg and cavity, may be provided to assist with locating the heat exchanger 130 onto the second stage 124 of the refrigerator.

Preferably, the location of the heat exchanger may be moved by a certain extent, independently of the location of the closed end of the sock.

In an embodiment, the heat exchanger 130 and inlet and outlet ports 134, 136 are assembled into the sock during its manufacture. The sock is then assembled into the OVC 14, preferably within the turret 18. Later during the assembly process, the refrigerator 17 is installed within the sock 15 so that the second stage 124 of the refrigerator interfaces with the heat exchanger 130. Fastener 138 is then tightened to apply a required interface pressure between the heat exchanger 130 and the second stage 124 of the refrigerator. Preferably, the fastener is captive to the heat exchanger, to facilitate this assembly step. In an alternative arrangement, the heat exchanger 130 may be provided with a through-hole, and a threaded stud may be provided, protruding from the second stage of the refrigerator such that, when installed, the threaded stud passes through the hole in the heat exchanger and a threaded nut can be applied to the stud, to provide the required mechanical fastening.

A re-sealable access port 140 is provided, allowing a technician to gain access to the fastener 138 within the sock, from outside of the OVC. As shown in FIG. 9, this may be achieved simply by placing an access port directly opposite the fastener(s) 138. The port should be arranged to isolate the interior of the sock 15 from the interior of the OVC 14. As illustrated, this may be achieved by attaching a bellows 142 between an access into the sock and the port 140 in the OVC. The bellows should be of a thermally insulating material to limit the influx of heat by conduction through the material of the port. Baffles, which may be removable, may be positioned within the port to reduce thermal influx by radiation from the port 140. Thermal radiation shields 16 should be placed between the sock 15 and the OVC 14 to reduce thermal influx to the sock from the material of the OVC. Typically, multi-layer insulation such as sheets of aluminized polyester will also be provided between the OVC 14 and the thermal radiation shield 16.

The port 140 may itself take a variety of forms. In the illustrated example, a plug 144 is provided with o-ring seals 146, and is largely held in place by differential pressure. Atmospheric pressure acts on the outer surface of the plug 144 while the vacuum within the sock acts in the inner surface of the plug. Preferably, a valve 148 is provided in the plug 144 to enable a vacuum within the sock 15 to be released in preparation for removal of the refrigerator. The same valve may be used for initially drawing the vacuum in the sock.

Figure 10:
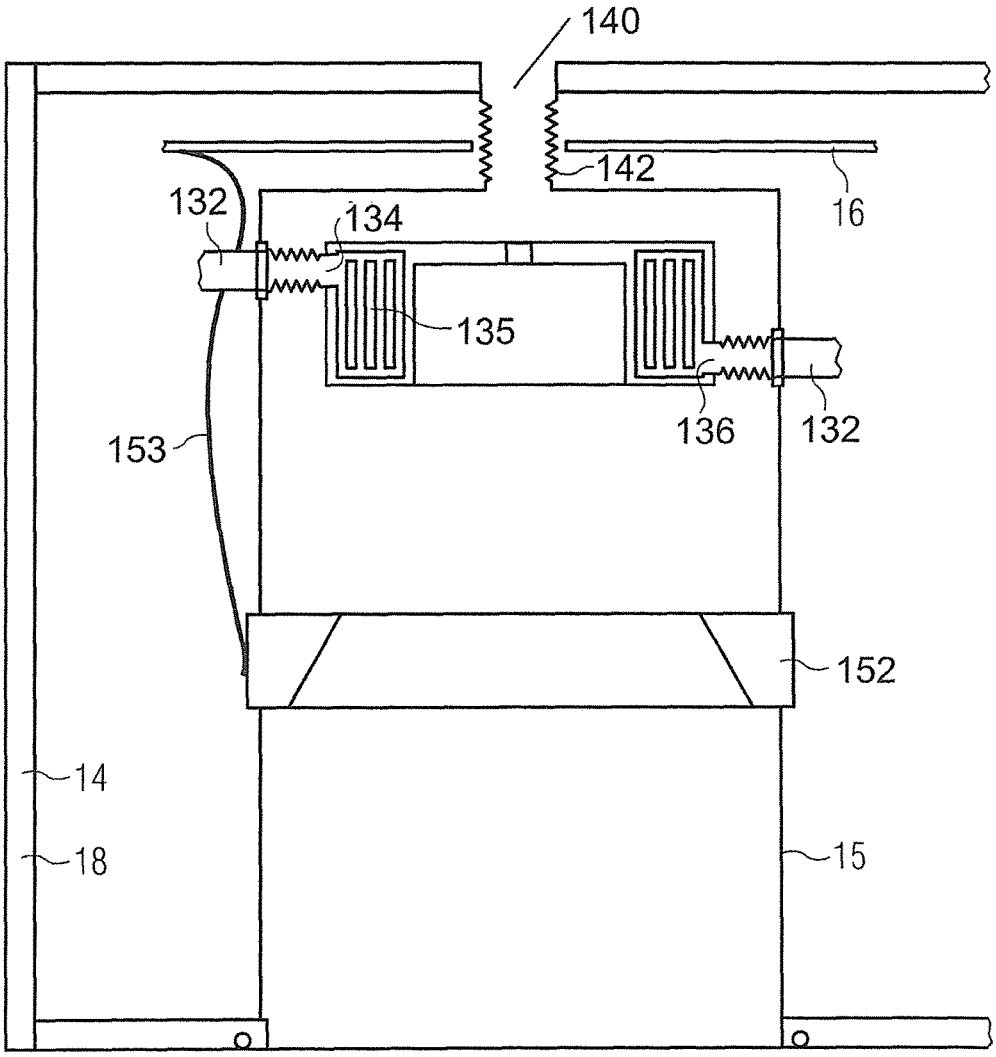
FIG. 10 represents a cross-section of a mounting arrangement for a cryogenic refrigerator according to an embodiment of the present invention.

FIG. 10 shows a view, similar to the view of FIG. 9, but of the mounting arrangement 150 only, with the refrigerator 17 and port plug 144 removed. The first stage 152 of the sock is shown, and the taper is visible. As described above, this taper assists in locating the refrigerator 17 within the sock 15, and in providing an effective thermal contact between the first stage 122 of the refrigerator and the first stage of the sock. First stage 152 of the sock is thermally joined 153 to the thermal radiation shield 16 to provide cooling of the thermal radiation shield to approximately the temperature of the first stage 122 of the refrigerator.

The arrangement shown in FIGS. 9-10, where the heat exchanger 130 forms a part of a thermosiphon cooling loop, is very efficient, since a complete flow of the cryogen may pass through the heat exchanger. Other arrangements may be provided, within the scope of the invention, for example heat exchanger 130 may be connected to a cryogen vessel 12 as shown in FIG. 1 by one or more tubes 132.

In the embodiment of FIG. 9, the or each fastener is located within a section of the sock extending between the first stage of the sock and the closed end of the sock. The fastener(s) act on the second stage of the refrigerator and the heat exchanger to mechanically clamp the second stage of the refrigerator into contact with the heat exchanger.

Figure 11:
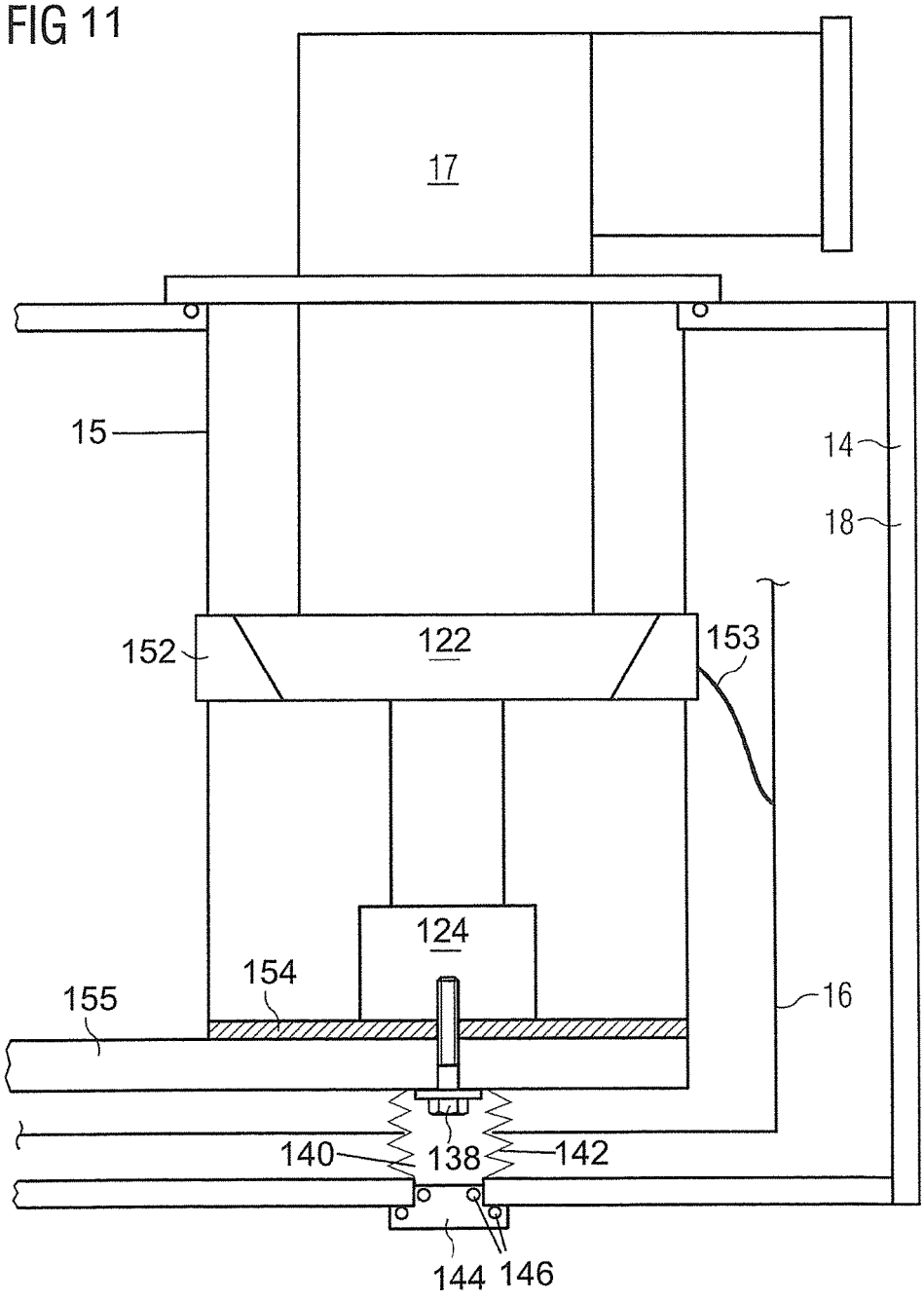
FIGS. 11-12 show schematic representations of other embodiments of the present invention.

FIG. 11 represents an embodiment in which the heat exchanger 130 which carries the cryogen flow is replaced by a thermal bus bar 155 in mechanical contact with the second stage 124 of the refrigerator. The sock 15 may be closed, as is conventional, by a second stage 154, and a mechanical fastener such as a captive bolt 138 may be provided in the thermal bus bar, to extend through a hole in the second stage of the sock into a threaded hole in the second stage 124 of the refrigerator.

In FIG. 11, the sock 15 has first 152 and second 154 stages, each contacting corresponding first 122 and second 124 stages of the cryogenic refrigerator 17 when in use, with one or more mechanical fasteners 138 provided to ensure effective thermal contact between the second stage 124 of the refrigerator and the second stage 154 of the sock. However, access must be provided through a re-sealable port 144 to provide access to tighten and loosen the fasteners 138 as required.

In the embodiment of FIG. 11, the or each fastener traverses the second stage 154 of the sock, to act on the second stage of the refrigerator and the second stage of the sock to mechanically clamp the second stage of the refrigerator into contact with the second stage of the sock.

Figure 12:
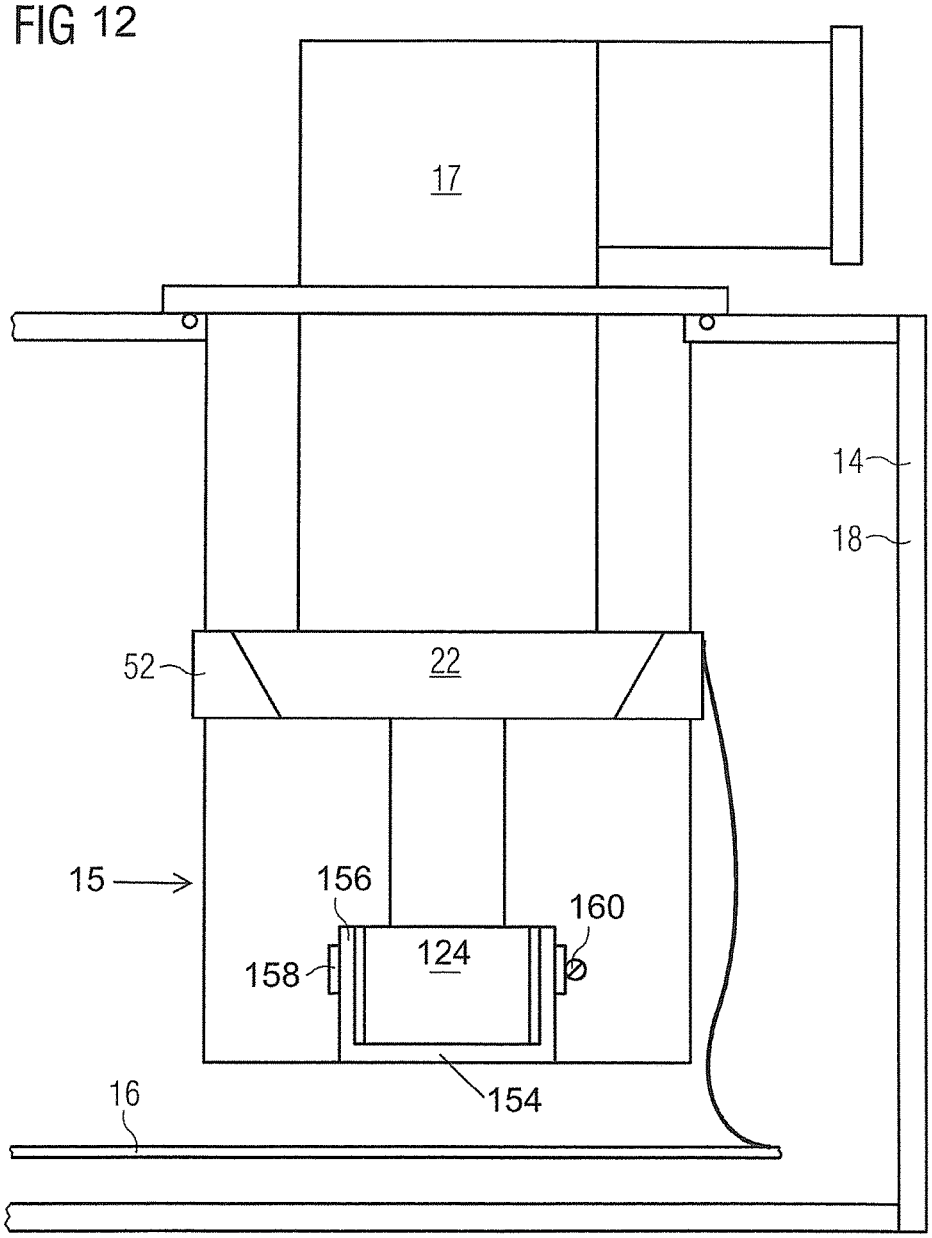
Figure 13:
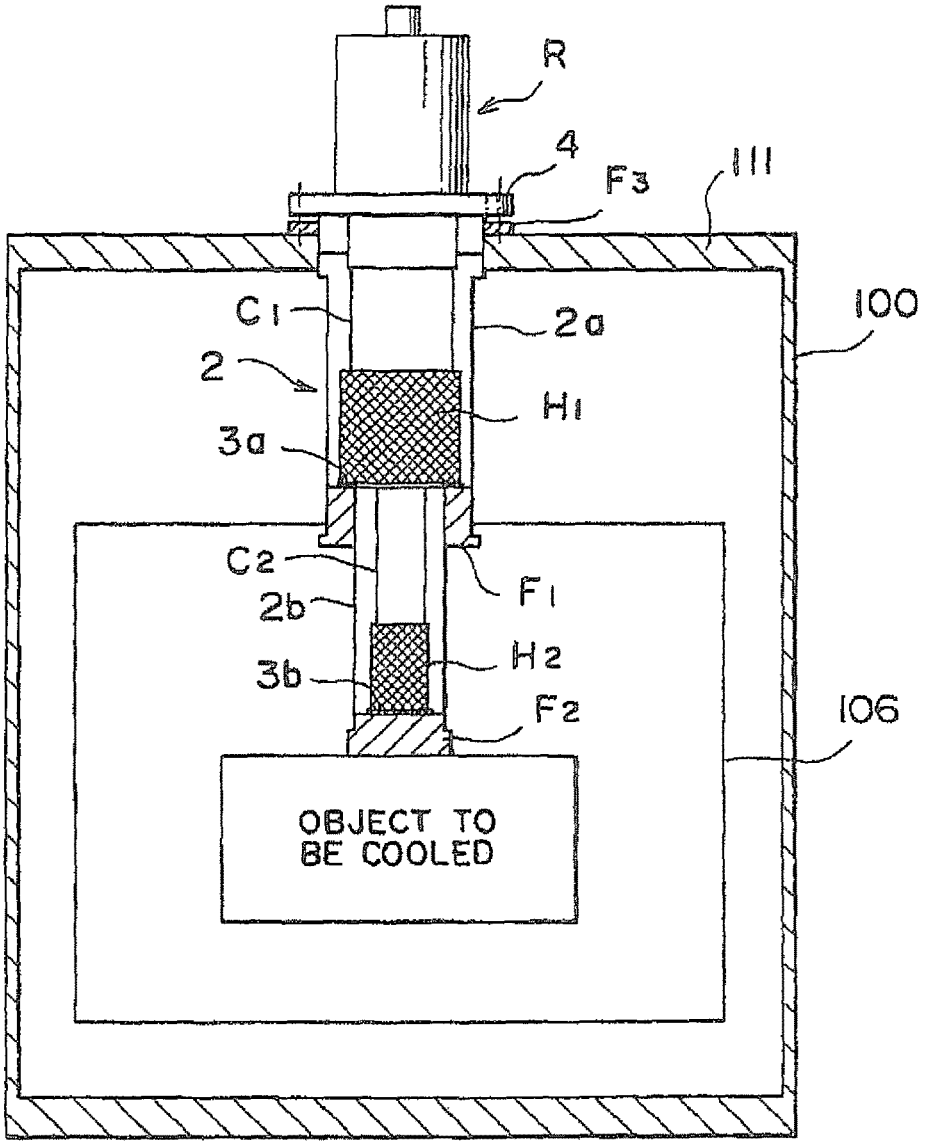
Fig. 13 (PRIOR ART)
FIG. 13, discussed above, shows a conventional assembly comprising a two-stage cryogenic refrigerator and associated mounting arrangement.

In the arrangement represented in FIG. 12, second stage 154 of sock 15 comprises a thermally conductive block, for example of copper. Protrusions 156 are provided, extending adjacent to the second stage 124 of the refrigerator. A releasable compression band 158, such as the commonly-known 'Jubilee' clip, is provided around the protrusions. With the refrigerator 17 in place, and a port (not illustrated) open to provide access, the releasable compression band 158 may be tightened in the appropriate manner, for example by tightening a drive screw 160. The port must then be closed, and a vacuum drawn inside the sock. The structure of the port may be as illustrated and described with reference to FIGS. 9 and 11, but may be more conveniently located in a side wall of the sock for arrangements such as shown in FIG. 12.

In the embodiments of FIGS. 12, the or each fastener is located within a section of the sock extending between the first stage of the sock and the second stage of the sock. The fastener(s) act on the second stage of the refrigerator and the second stage of the sock to mechanically clamp the second stage of the refrigerator into contact with the second stage of the sock.

The present invention accordingly provides arrangements in which the second stage of a two-stage cryogenic refrigerator is clamped into contact with a cooled component—such as a second stage of the sock or a heat exchanger.

The arrangement of the present invention can be used in any orientation or position on the magnet where practicable, provided that the construction of the refrigerator will permit such arrangement. The refrigerator is shown inverted in FIGS. 9 and 10 to illustrate the potential to overcome a height restriction or requirement for the heat exchanger 130 to be positioned as high as possible.

In each embodiment, the present invention avoids placing significant forces on the body of the refrigerator.

Although modifications and changes may be suggested by those skilled in the art, it is the intention of the inventors to embody within the patent warranted heron all changes and modifications as reasonably and properly come within the scope of their contribution to the art.

We claim as our invention:

1. An assembly having a two-stage cryogenic refrigerator and associated mounting arrangement, said assembly comprising:

a sock having first and second stages corresponding to first and second stages of the refrigerator, and said sock having a receptacle therein into which said refrigerator is axially received through an open end of said receptacle, with an opposite end of said receptacle being closed;

the first stage of the refrigerator in said receptacle being in thermal contact with the first stage of the sock and the second stage of the refrigerator being in thermal contact with the second stage of the sock;

a bracing piece that surrounds the second stage of the refrigerator and that is attached to the second stage of the refrigerator by first fasteners that hold the bracing piece relative to said second stage of the refrigerator so as to cause a lower surface of the second stage of the refrigerator to extend into the sock beyond the bracing piece, the bracing piece comprising axially symmetrical protrusions that extend radially away from the second stage of the refrigerator, each of the protrusions carrying a second fastener that is a captive fastener, the captive fasteners attaching the bracing piece to the second stage of the sock and acting on the bracing piece so as to cause the bracing piece to press the second stage of the refrigerator into contact with the second stage of the sock, thereby mechanically clamping the second stage of the refrigerator into contact with the second stage of the sock; and said first stage of said refrigerator having an upper interface piece that is externally exposed at said opening of said receptacle in said sock when said refrigerator is inserted into said sock, said upper interface piece having openings therein that allow access to said captive fasteners while said refrigerator is inserted into said sock.

2. An assembly according to claim 1, wherein the sock comprises a lower wall extending between the first stage of the sock and the second stage of the sock, and an upper wall extending away from the first stage of the sock in a direction opposite to the lower wall, wherein the lower wall comprises a bellows portion.

3. An assembly according to claim 1, wherein said at least one fastener is a bolt.

4. An assembly according to claim 1, wherein said lower surface of the second stage of the refrigerator extends beyond the bracing piece so as to be in contact with the second stage of the sock.

5. An assembly according to claim 1, comprising mechanical tie rods that brace the first stage of the sock against a second stage retaining structure to mechanically restrain the second stage of the sock against the first stage of the sock.

6. An assembly according to claim 2 wherein the lower wall of the sock, including the bellows portion, has a length that causes tightening of the at least one fastener to compress the bellows portion.

7. An assembly according to claim 2 wherein a relative thermal contraction causes compression of bellows portion as the refrigerator cools to an operational temperature.

* * * * *